US006173466B1

(12) United States Patent
Chen

(10) Patent No.: US 6,173,466 B1
(45) Date of Patent: Jan. 16, 2001

(54) PLIERS FOR FORMING ELECTRICAL CONNECTORS

(76) Inventor: C. J. Chen, No. 17, Mei-Nin St., Tai-Shan Hsiang, Taipei Hsien (TW)

( * ) Notice: Under 35 U.S.C. 154(b), the term of this patent shall be extended for 0 days.

(21) Appl. No.: 09/481,000

(22) Filed: Jan. 11, 2000

(51) Int. Cl.[7] ..... B25F 1/00
(52) U.S. Cl. ..... 7/107; 29/33 M; 29/758
(58) Field of Search ..... 7/107, 125, 127, 7/129, 131, 132, 158; 29/566.4, 33 M, 751, 758

(56) References Cited

U.S. PATENT DOCUMENTS

| | | | | |
|---|---|---|---|---|
| 4,713,874 | * | 12/1987 | Schwartz | 7/107 |
| 4,754,636 | * | 7/1988 | Kautz et al. . | |
| 4,981,032 | * | 1/1991 | Chen | 7/107 |
| 4,986,106 | * | 1/1991 | Gwo-Jiang | 7/107 |
| 5,109,591 | * | 5/1992 | Hung | 7/107 |
| 5,168,592 | * | 12/1992 | Jee | 7/107 |
| 5,992,002 | * | 11/1999 | Hung | 7/107 |

* cited by examiner

*Primary Examiner*—David A. Scherbel
*Assistant Examiner*—Joni B. Danganan
(74) *Attorney, Agent, or Firm*—Rabin & Champagne, P.C.

(57) ABSTRACT

A pliers for forming electrical connectors includes a body, connecting members, a sliding block, and a pliers' arm pivotably joined together. The body includes a jaw, an angled handle, a recess in the jaw, and connector cavities. The sliding block provided in the recess includes an engagement portion slidable with respect to the recess. The pliers' arm has a top cam member being pivotably secured to the jaw. The connecting members are interconnected between the sliding block and cam member. As such, the pliers' arm is operable to pivot about the handle which in turn moves the sliding block through the pivotal movement of the cam member and the linear movement of connecting member so as to move the engagement portion into the connector cavities to press on connectors. Moreover, a convenient working arrangement is achieved because the connector pressing direction in the connector cavities is parallel to the hand applying force and the position of inserting the connectors into the connector cavities can be seen when working.

4 Claims, 5 Drawing Sheets

PLIERS FOR FORMING ELECTRICAL CONNECTORS

BACKGROUND OF THE INVENTION

1. Field of Invention

The present invention relates to pliers-type hand tools and more particularly to a pair of pliers suitable for forming telephone line connectors in a convenient and effective manner.

2. Description of Related Art

Conventionally, a telephone line connector includes a body, a plurality of metal conductors in one side of the body, and a line inserted in from the opposing side of the body and which is in electrical contact with the metal conductors. An engagement piece is provided for securing the metal conductors to the body and fastening the electrical contact with the line. A common practice, after line has been inserted in the body, is to use a tool to insert the metal conductors guided by the engagement piece, into the body to press on the line. As a result, the line is secured to the body and the electrical contact is fastened.

Such a tool for achieving the above is shown in FIG. 1. This conventional pair of pliers is known as pliers for forming electrical connectors. The pliers includes a pair of parts wherein the upper portion forms a jaw, the lower portion forms a pair of handles; and a pivot joint pivotably joins the upper and lower portions. The jaw has a central engagement member and a connector recess above the engagement member for receiving a connector. The handles may approach or move away from each other a predetermined distance by pressing. The engagement member may move into or away from a connector recess accordingly. As such, the engagement member may press the engagement piece into the body of the connector to secure the line to connector. The connector pressing direction in such pliers is perpendicular to the hand applying force on the handles so as to facilitate the work. Generally, workers use their right hands to grasp the handles to hold the pliers in about a vertical direction, and use their left hands to put the connector into the connector recess. Then, the line in the connector. Finally, force is applied on the pliers to conduct a pressing action. However, the engagement piece is positioned downwardly if the pliers is in about a vertical direction. This can block the worker's view. Thus, improvement is needed.

SUMMARY OF THE INVENTION

It is therefore an object of the present invention to provide a pair of pliers suitable for forming electrical connectors in a convenient and effective manner.

The advantages of the present invention are realized by providing a pair of pliers for forming electrical connectors comprising a body, one or more connecting members, a sliding block, and a pliers arm pivotably joined together. The body includes a jaw, a handle extended from the jaw to form an angle therebetween, a recess within the jaw, and a plurality of connector cavities in communication with the recess for receiving the connectors. The sliding block provided in the recess includes an engagement portion slidable with respect to the recess. The pliers arm has a top cam member that is pivotably secured to the jaw. The connecting members are interconnected between the sliding block and cam member. As such, the pliers arm is operable to pivot about the handle which in turn moves the sliding block through the pivotal movement of the cam member and the linear movement of the connecting member so as to move the engagement portion into connector cavities to press on the connectors. Moreover, a convenient work position is achieved because the connector pressing direction in the connector cavities is parallel to the force applied to the hand and the inserting of the connectors into the connector cavities can be seen when working.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow. The illustrations below are not limitative of the present invention, and wherein.

DETAILED DESCRIPTION OF THE INVENTION

Figure 1:
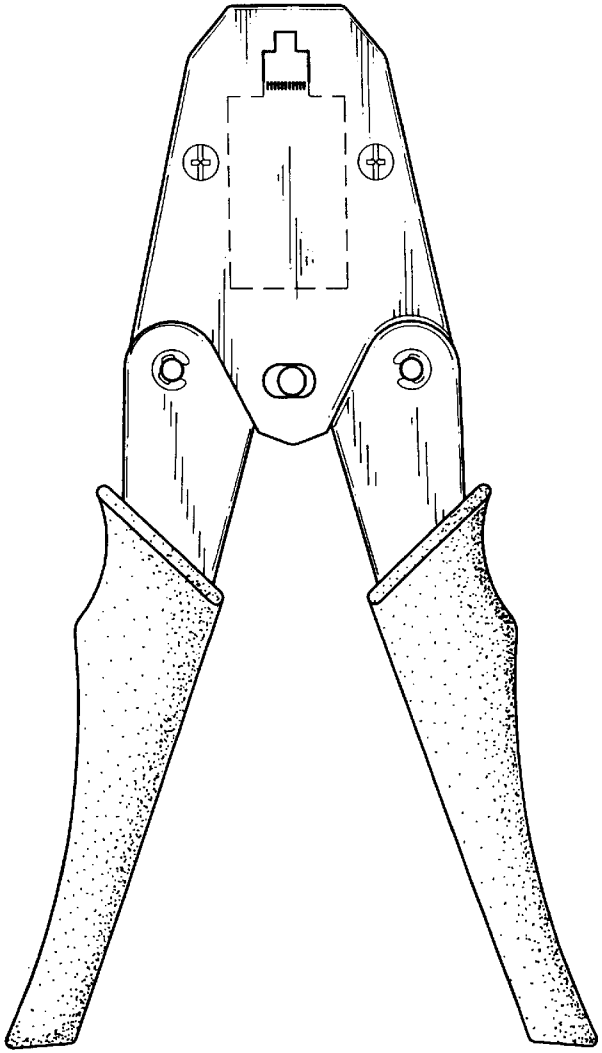
FIG. 1 (PRIOR ART)
FIG. 1 is a side view of a prior art pair of pliers.
Figure 2:
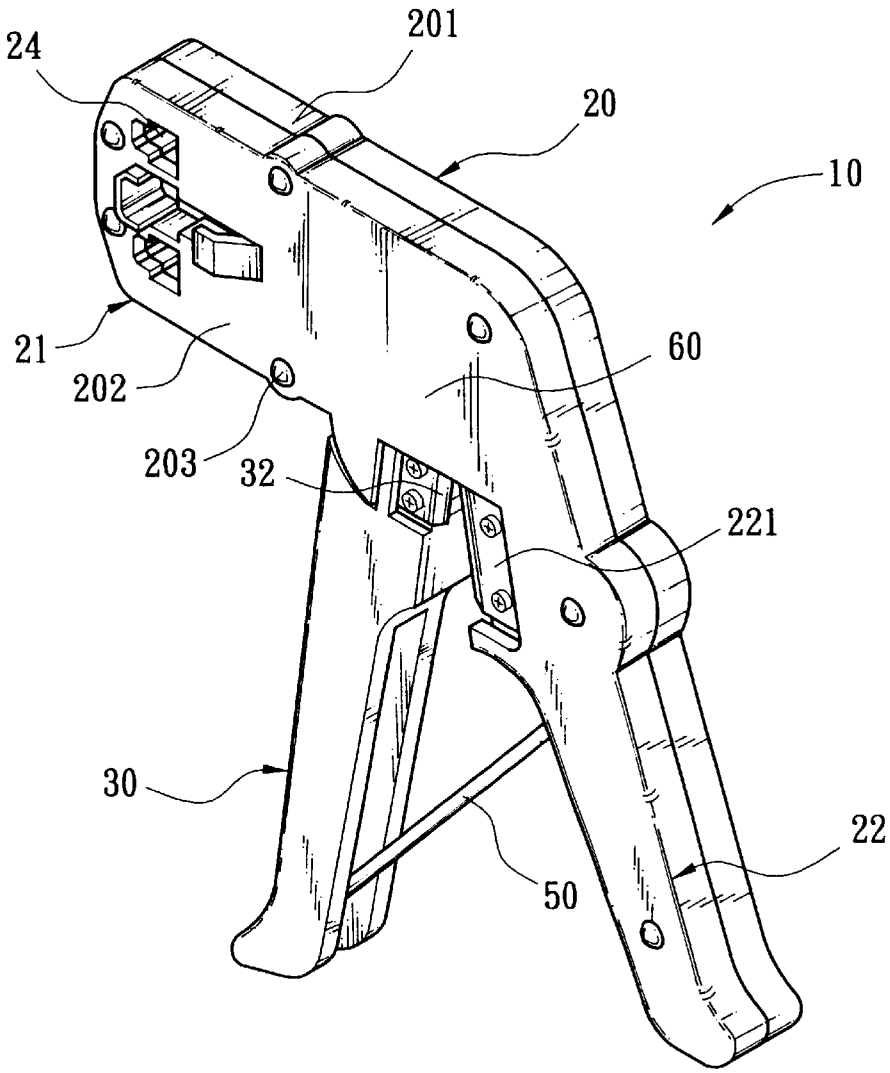
FIG. 2 is a perspective view of a pair of pliers according to the invention.
Figure 3:
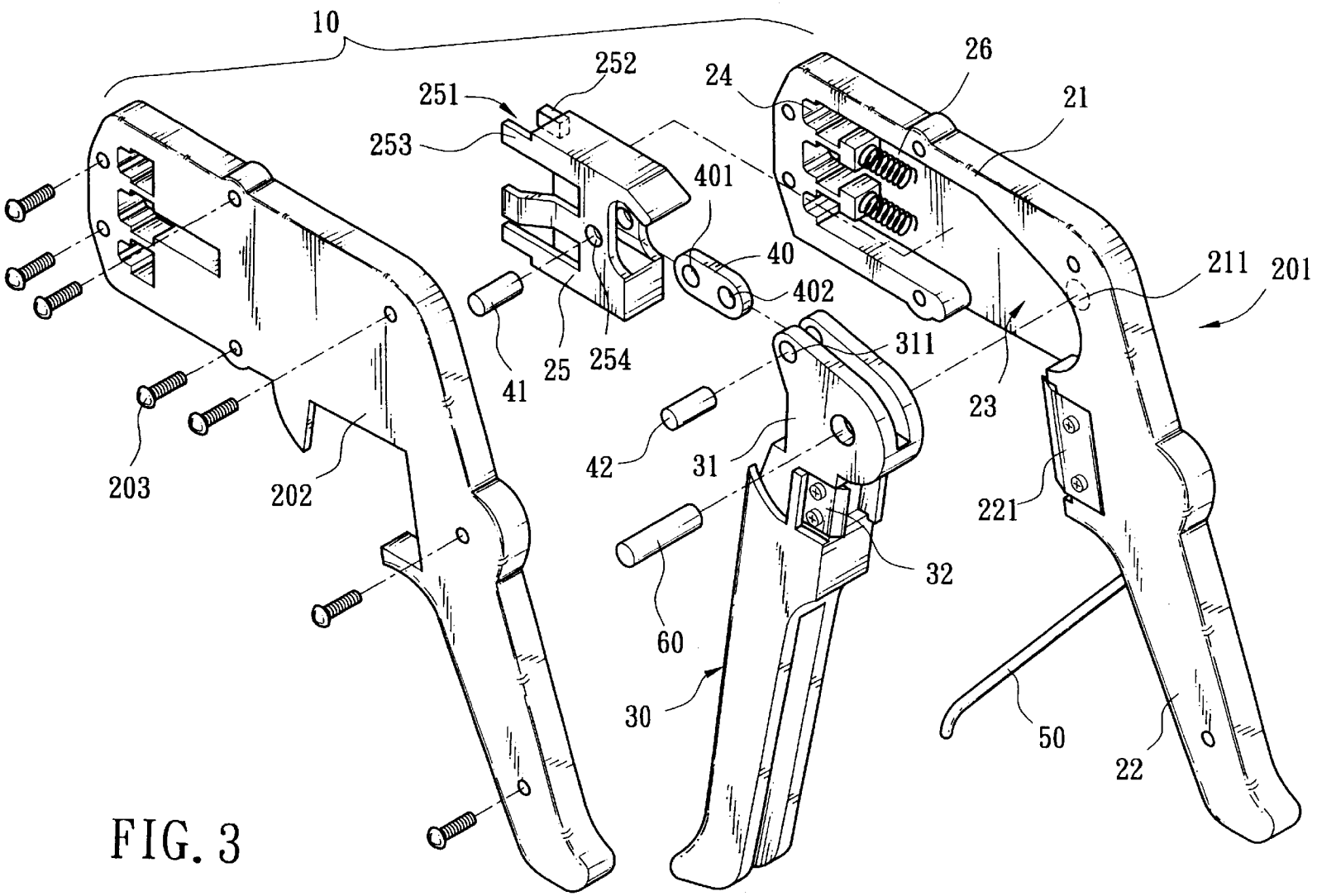
FIG. 3 is an exploded view of FIG. 2.

Referring to FIGS. 2–5, there is shown a pair of pliers constructed in accordance with the invention, comprising a body 20 and a pliers' arm 30 pivotably joined together. Body 20 includes a first portion 201, a second portion 202, and a plurality of screws 203 to threadedly secure second portion 202 to first portion 201. The body comprises a jaw 21, a handle 22 extended from jaw 21 to form an angled member, a recess 23 within the jaw 21, and a plurality of connector cavities 24 in communication with recess 23 for receiving connectors (not shown). A sliding block 25, provided in the recess 23, is abutted to connector cavities 24. Sliding block 25 includes an engagement portion 251 having a first engagement member 252 and a second engagement member 253. Engagement portion 251 may slide with respect to recess 23 to move into connector cavities 24 to press on connectors so as to engage a line with each connector. This is illustrated in a first position in FIG. 5. While in an unused condition, sliding block 25 is compressed by the expansion of one or more elastic members (e.g, two coil springs as shown) 26 such that engagement portion 251 tends to move away from connector cavities 24 as shown in second position in FIG. 4.

As shown, pliers' arm 30 is provided under jaw 21 with a cam member 31 on top, and which is pivotably secured to jaw 21 with a pin 60. One or more connecting members 40 are provided (one is shown). Connecting member 40 is interconnected between sliding block 25 and cam member 31. In detail, connecting member 40 has two holes 401, 402 on two opposing ends. Hole 401 and hole 254 of sliding block 25 are engaged together with pin 41, while hole 402 and hole 311 of cam member 31 are engaged together with pin 42. As such, a worker may press pliers' arm 30 to pivot arm 30 about handle 22, which in turn moves sliding block 25 through the pivotal movement of cam member 31 and the linear movement of connecting member 40. That is, sliding block 25 moves from a second position (FIG. 4) to first position (FIG. 5). An angled spring 50 is secured within handle 22, and is engaged with pliers' arms 30 such that pliers arm 30 and handle 22 may form a predetermined angle in a normal (i.e., uncompressed) condition. As stated above, a worker may press pliers' arm 30 to pivot arm 30 about handle 22 when in use.

Figure 4:
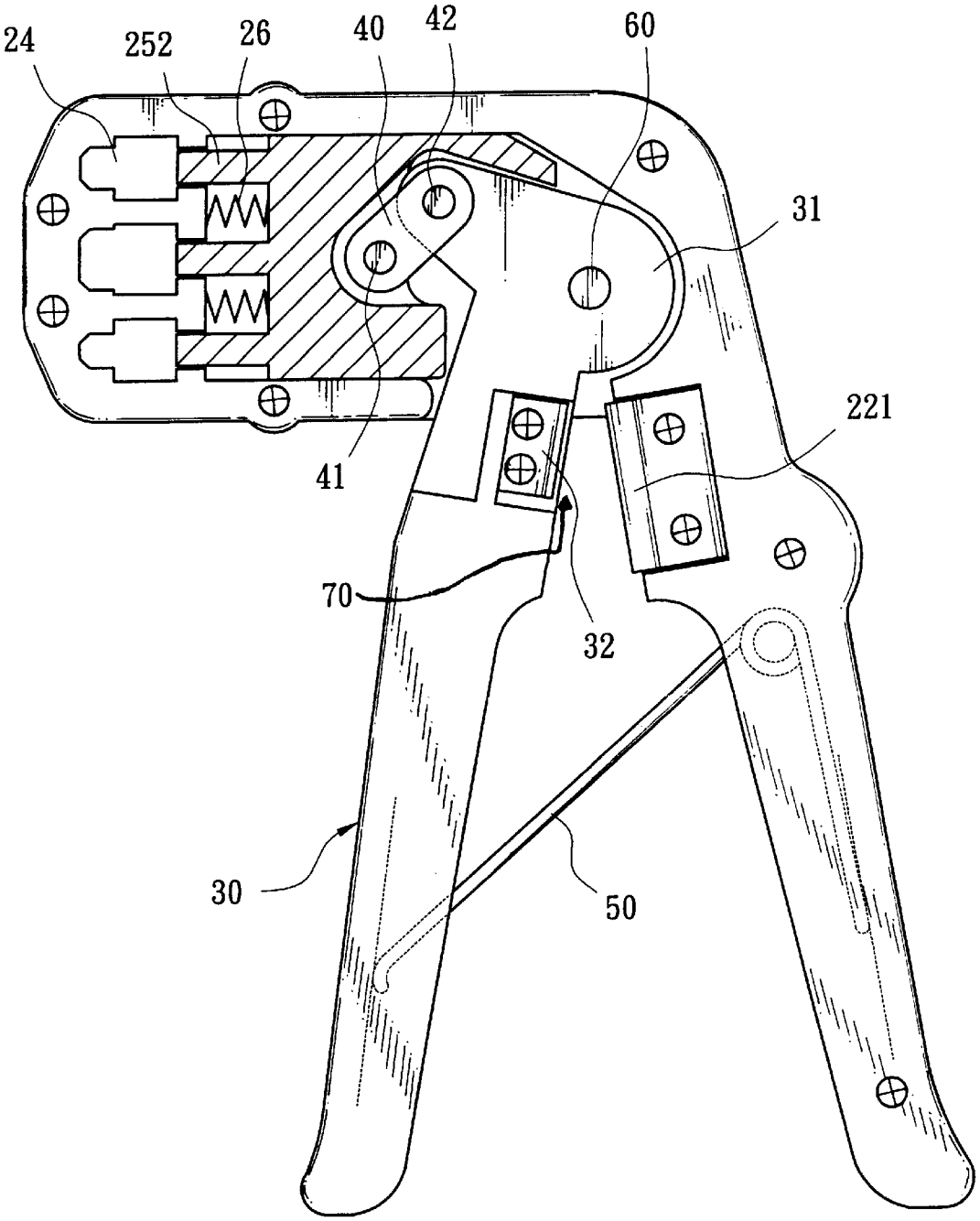
FIG. 4 is a side view of the pliers of the invention, where the pliers' arm is not pressed.
Figure 5:
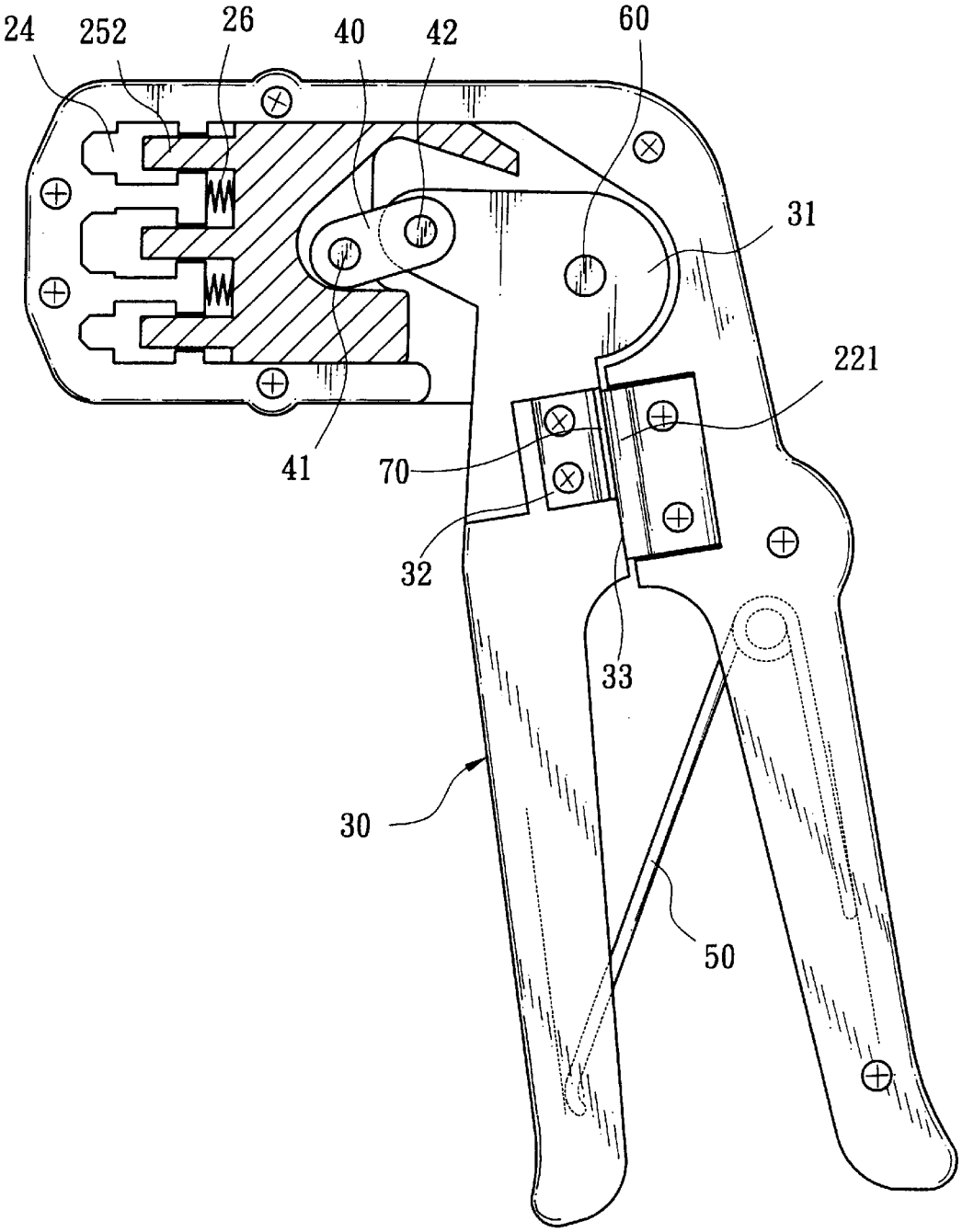
FIG. 5 is similar to FIG. 4, where the pliers' arm is pressed.

Referring to FIGS. 4 and 5 specifically, it is seen that jaw 21 is at a predetermined angle with respect to handle 22 as implemented in the pliers of the invention, while conventional pliers are elongate members. Also, connector cavities 24 are provided near the tip of jaw 21. As such, the position for inserting connectors into connector cavities 24 is at a predetermined distance away from the position of the hand which presses on pliers' arm 30 to move it closer to handle 22. This is a convenient design. Additionally, the connector pressing direction in the connector cavities 24 is parallel to the hand applying force so as to facilitate a working action. Moreover, a worker may see what he/she is doing when working.

In one embodiment, a long blade 221 and an opposing short blade 32 are provided in handle 22 and pliers' arm 30, respectively, for cutting and stripping telephone lines. Short blade 32 is provided on a recessed portion of pliers' arm 30 such that a gap 70 may be formed between long blade 221 and short blade 32 when pliers' arm 30 is pressed to move arm 30 near handle 22. Such gap 70 acts as a telephone line stripping area. Also, an anvil 33, formed below the short blade 32 of pliers' arm 30, is in contact with long blade 221 when blades 221, 32 are engaged. This anvil 33 acts as a telephone line cutting area.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pair of pliers for forming electrical connectors, comprising:

a body including a jaw, a handle extended from the jaw to form an angle therebetween, a recess within the jaw, and a plurality of connector cavities in communication with the recess for receiving the connectors;

at least one connecting member;

a sliding block provided in the recess, and including an engagement portion slidable with respect to the connector cavities such that the sliding block can move between a first position in the connector cavities and a second position out of the connector cavities;

at least one elastic member provided in the jaw to maintain the sliding block in the second position; and a pliers' arm having a top cam member pivotably secured to the jaw, the cam member being pivotably connected to the connecting member which is pivotably attached to the sliding block such that the pliers' arm is operable to pivot about the handle for causing the sliding block to move from the second position to the first position.

2. The pair of pliers of claim 1, further comprising a spring secured within the handle and being engaged with the pliers' arm such that the pliers' arm is at a predetermined angle with respect to the handle when the spring is in an uncompressed condition.

3. The pair of pliers of claim 1, wherein the handle has a first blade and the pliers' arm has an opposing second blade and an anvil.

4. The pair of pliers of claim 1, wherein the connecting member has two end holes, the cam member has a hole, and the sliding block has a hole such that one end hole of the connecting member is pivotably engaged with the hole of the sliding block, while the other opposing end hole of the connecting member is pivotably engaged with the hole of the cam member.

* * * * *